United States Patent [19]

Kwake

[11] Patent Number: 4,686,799

[45] Date of Patent: Aug. 18, 1987

[54] THEATRE STRUCTURE WITH INDIVIDUAL MULTIPLE LOUNGES

[76] Inventor: John P. Kwake, 2507 Carob Dr., Los Angeles, Calif. 90046

[21] Appl. No.: 840,046

[22] Filed: Mar. 17, 1986

[51] Int. Cl.[4] ..... E04H 3/10

[52] U.S. Cl. ..... 52/8; 52/6

[58] Field of Search ..... 52/6, 8; 181/30

[56] References Cited

U.S. PATENT DOCUMENTS

| | | | |
|---|---|---|---|
| 723,426 | 3/1903 | Valk | 52/6 |
| 3,210,895 | 10/1965 | Graf | 52/6 |
| 3,487,595 | 1/1970 | Schumann | 52/6 X |
| 3,545,143 | 12/1970 | Bankston | 52/6 |
| 3,823,517 | 7/1964 | Penaloza | 52/6 |
| 4,075,795 | 2/1978 | Thomas | 52/8 |

FOREIGN PATENT DOCUMENTS

| | | | |
|---|---|---|---|
| 716596 | 12/1931 | France | 52/6 |
| 776441 | 1/1935 | France | 52/6 |

OTHER PUBLICATIONS

Arena Stage Publication.

*Primary Examiner*—Henry E. Raduazo
*Assistant Examiner*—Creighton Smith

[57] ABSTRACT

This disclosure is directed to a theatre design having the following: a permanent stage; a tiered arrangement of enclosed individual suites formed in an arcuate pattern, each individual suites having an unobstructed viewing area of the stage and each individual suite being entirely encloseable with respect to the other suites; a series of tiered rows of open-air gallery seating facing the stage, arranged in arcuate pattern below the tiered arrangement of individual suites; a first entrances adjacent to, and for, the gallery seating; and a second lobby type entrance for, and nearest the individual suites, separate from the entrance for, and nearest the individual suites, separate from the entrance for the gallery seating.

16 Claims, 7 Drawing Figures

Fig. 1
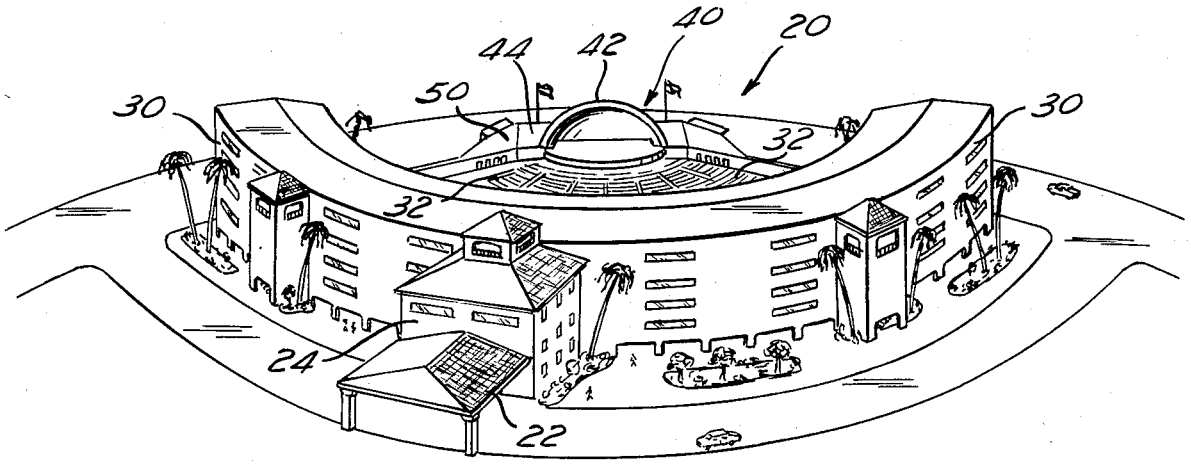
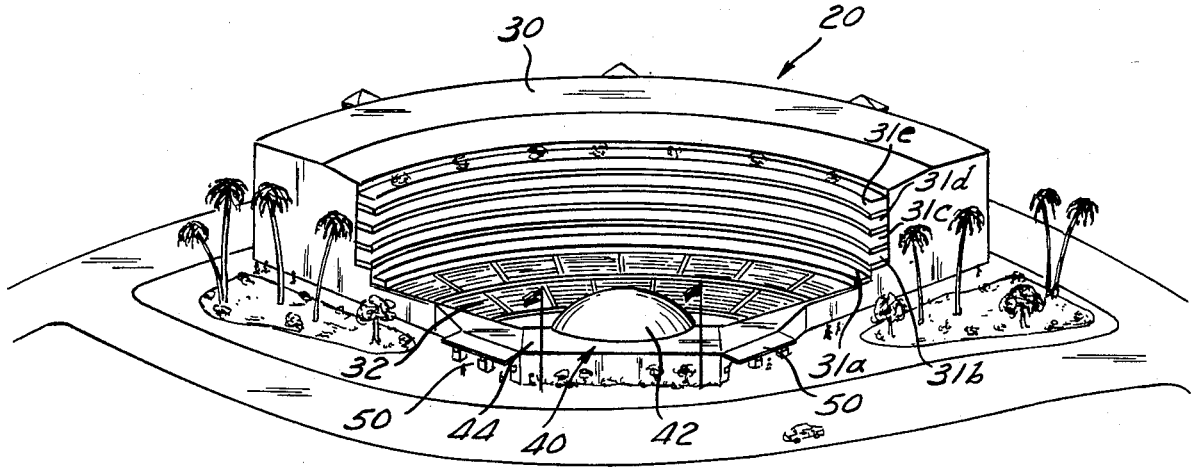
Fig. 2

THEATRE STRUCTURE WITH INDIVIDUAL MULTIPLE LOUNGES

BACKGROUND OF THE INVENTION

This invention relates to a novel design of a theatre entertainment building wherein multiple individual lounges are provided to view a live performance on a stage, or a motion picture on a screen, or other event. The closest prior art known to the applicant is:

| Inventor | Pat. No. |
|---|---|
| Bankston | 3,545,143 |
| Valk | 723,426 |

Bankston discloses a theatre having a generally parallel number of rows, each comprising a series of individually enclosed booths. Each row of booths is arranged in a generallly semi-circular manner with respect to the screen and each row of booths is arranged in a tiered manner, with the lowermost row of booths being closest to the screen and the highest row of booths being furthest from the screen. Each individual booth in Bankston provides for the seating of several individuals.

The Valk patent discloses a building having a central platform or stage, to one side of which (e.g. the front) is placed a general seating or gallery area, and on the other side of which (the rear) is placed, in semi-circular fashion, a series of small rooms called classrooms. The building is intended for religious and/or teaching purposes, and may be used as s single chamber or divided into the gallery and classroom areas.

SUMMARY OF THE INVENTION

The theatre design of this invention is directed to a novel combination of elements, viz.:

- a permanent stage;
- a tiered arrangement of enclosed individual suites formed in an arcuate pattern, each individual suite having an unobstructed viewing area of the stage and each individual suite being entirely encloseable with respect to the other suites;
- a series of tiered rows of open-air gallery seating facing the stage, arranged in an arcuate pattern below the tiered arrangement of individual suites;
- a first entrance adjacent to, and for, the gallery seating;
- and a second lobby-type entrance for, and nearest the individual suites, separate from the entrance for the allery seating.

The invention is also directed to other features such as clear lines of sight from the individual suites to the stage area, and geo-thermal heating and/or solar heating of suite and general admission seating areas.

BRIEF DESCRIPTION OF THE DRAWINGS

FIG. 1 is a perspective view of the suite entrance side of the threatre of this invention;

FIG. 2 is a perspective view of the general admission entrance side of the theatre;

DETAILED DESCRIPTION OF THE INVENTION

Figure 3:
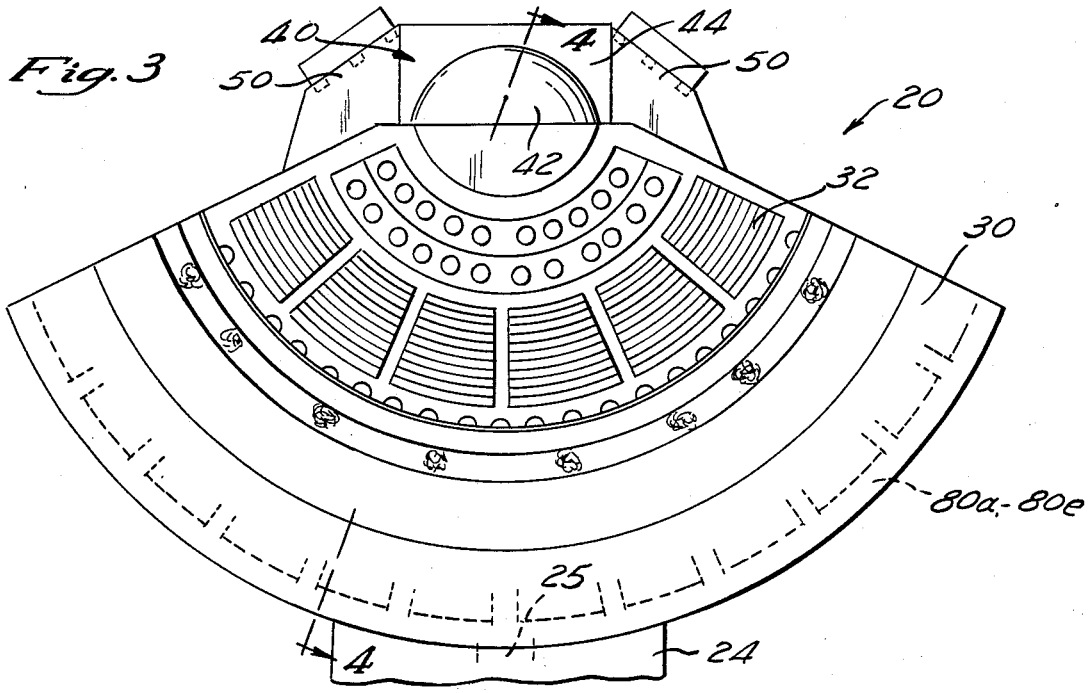
FIG. 3 is a plan view of the theatre.

Referring initially to FIGS. 1 and 2, the theatre of this invention is designated generally by the numeral 20. The entrance to the individual suites is a covered entrance or portico 22 wide enough to accommodate automobiles thereunder. The portico 22 leads to the main entrance of a lobby area 24. The lobby area 24 is, preferably, a multi-story structure, and has entrances 25 (shown in phantom in FIG. 3) on each floor leading to a series of hallways **80*a*–80*e* (also shown in phantom) which in turn, lead to the tiered individual suites, contained in a lounge or suite building 30. Each tier of individual suites is collectively designated by the numerals 31*a*–31*e* (See FIGS. 2 and 4). Below, and in front of, the lowermost tier 31*a* of individual suites of building 30, there is provided a series of rows of seats for general admission seating, generally designated as the general admission seating area 32. (See FIGS. 2 and 4**).

It will be noted that the general admission seating area 32 and suite building 30 are arranged in arcuate fashion about the permanent stage structure 40. The stage structure 40 is provided, preferably, with an acoustic shell 42, dressing rooms, scene docks, and storage areas (these latter being designated generally at 44), as is conventionally found in a theatre for the performing arts. Pedestrian entrances 50, to the general admission seating area 32, flank either side of the stage 40.

Figure 4:
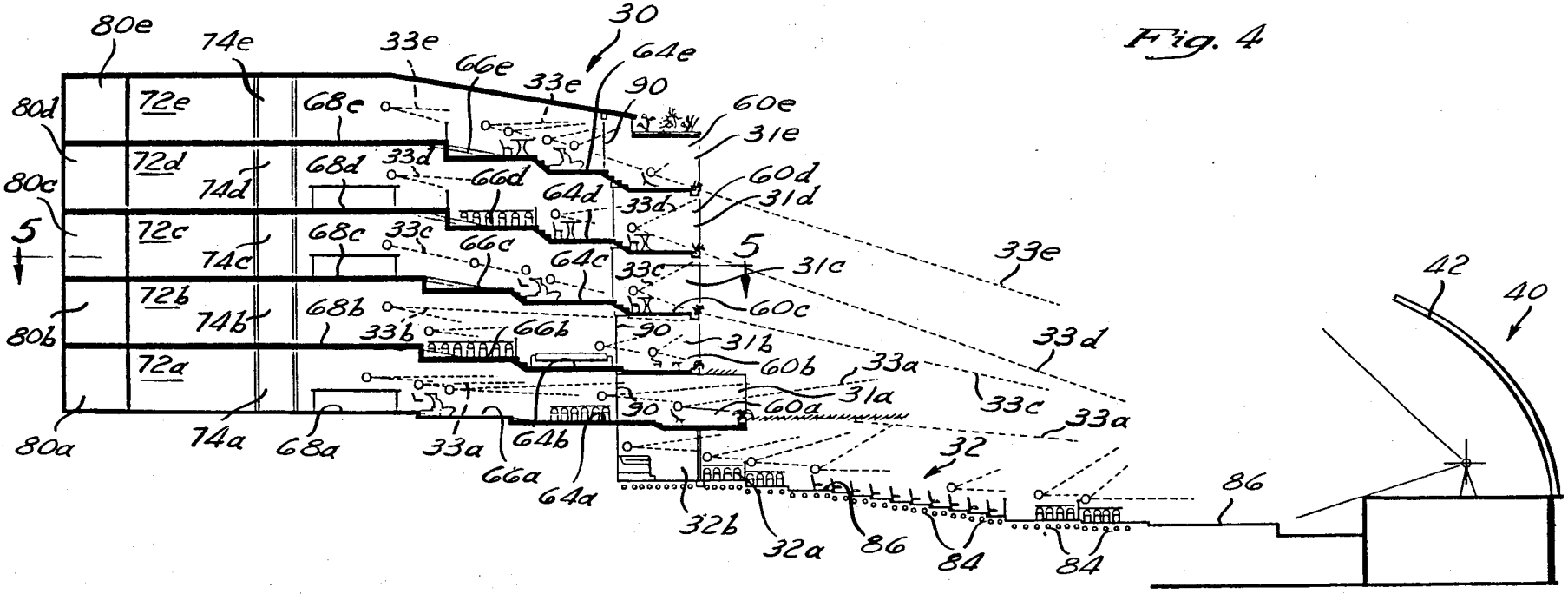
FIG. 4 is a cross-sectional view taken along the line 4—4 of FIG. 3.

Referring now to FIGS. 4 in particular, the specific relationship of the individual suites **31*a*–31*e*, the general admission seating area 32 and the permanent stage 40 is shown, and it will be noted that the suites 31*a*–31*e* all have an obstructed view of the stage 40, the sight lines from the suites being indicated by dotted line and being designated by the numerals 33*a*–33*e*, these latter designations corresponding to the sight lines from the corresponding suites 31*a*–31*e***.

Figure 6:
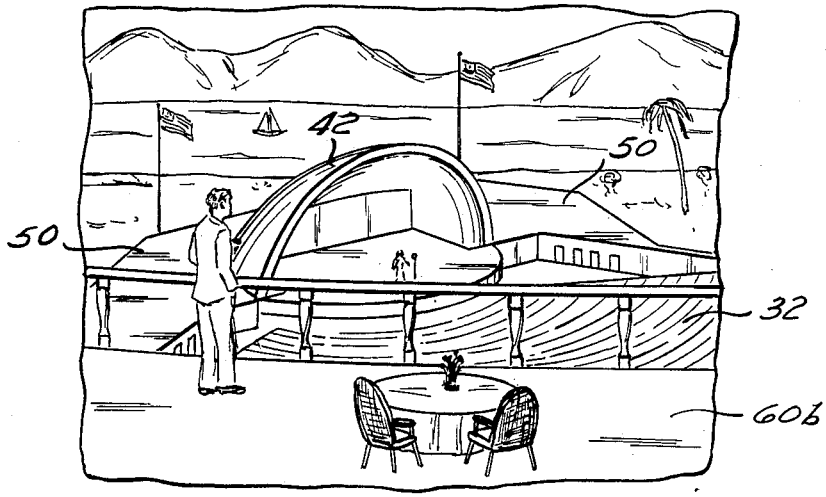
FIG. 6 is a perspective view taken from the balcony of a suite at approximately point A in FIG. 4.
Figure 7:
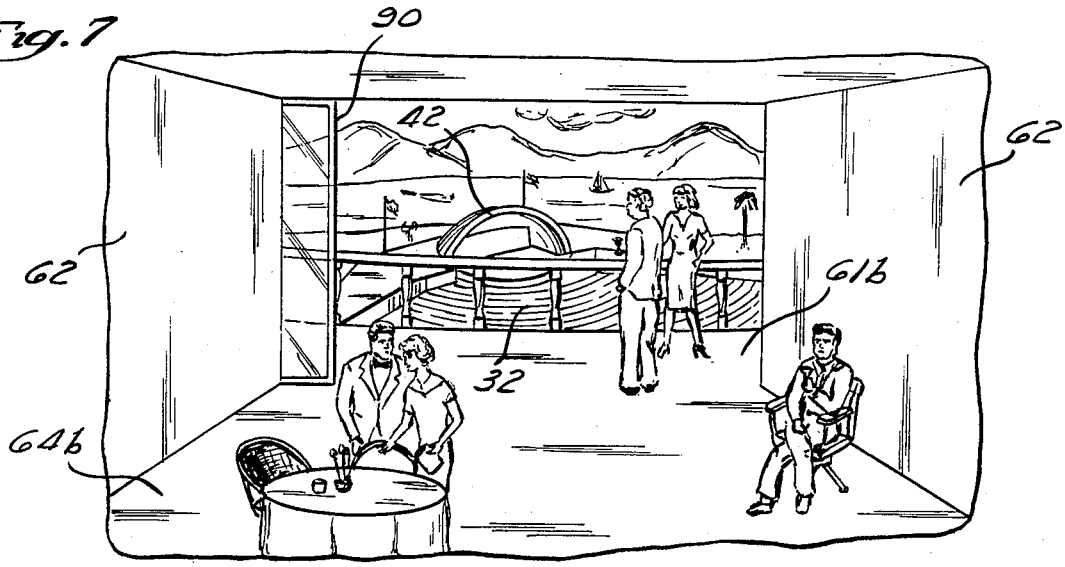
FIG. 7 is a perspective view taken from the interior of a suite at approximately point B in FIG. 4.
Figure 5:
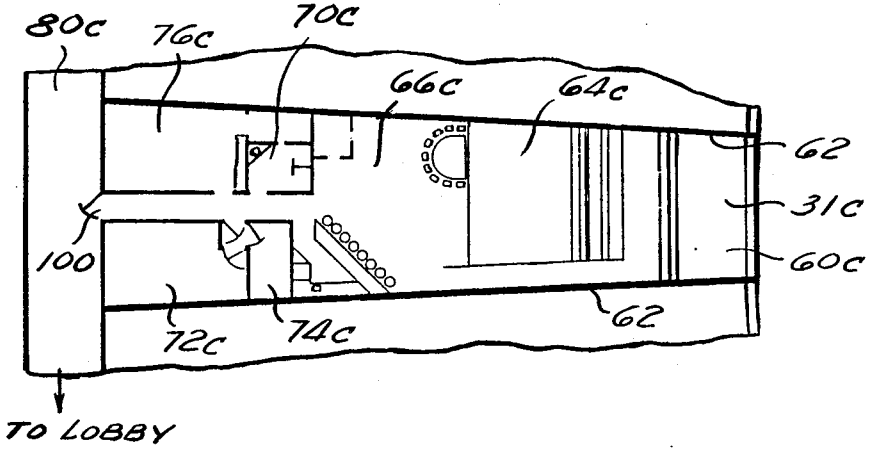
FIG. 5 is a plan view of an individual suite, taken along the line 5—5 of FIG. 4.

Each of the individual suites **31*a*–31*e* is preferably large enough to accommodate 40–50 persons, and is preferably constructed in multi-levels. Thus, each tier of suites 31*a*–31*e* have a lowermost terrace level 60*a*–60*e*, respectively. The terrace levels are open to the air, as best shown in FIGS. 6 and 7. Seating areas 64*a*–*e*, 66*a*–*e*, and bar areas 68*a*–*e* are preferably placed at succeedingly higher levels within each tier of individual suites, 31*a*–31*e*, respectively. To the rear of the suites 31*a*–31*e* are placed restrooms 70*a*–70*e*, and rest areas or bedrooms 72*a*–72*e*, dressing or closet areas 74*a*–74*e*, and office or kitchen areas 76*a*–76*e*, respectively. The rear of each tier of suites 31*a*–31*e* is connected to hallways 80*a*–80*e* by entrances 100 (See FIG. 5). A typical floor plan of a 3rd floor suite, 31*c*, is shown in FIG. 5. The hallways 80*a*–80*e* are connected to the main lobby area 24, as earlier mentioned. Each suite is separated from adjacent suites by sidewalls 62, and may be completely enclosed by sliding glass walls 90. (See FIGS. 4 and 7**).

Heating of the general admission (outdoor) areas may be by means of geo-thermal coils 84 set in the floor 86 below the general admission seats. Heating of the suites **30*a*–30*e*** may be by means of a conventional solar heating system (not shown).

It will be seen from the foregoing that each tier of individual suites **30*a*–30*e* are isolated, one from the other, but all have an unobstructed view of the stage area 40. Sliding glass walls 90 open up the interior portions 64***a–e*, 66*a–e*, etc. of the suites 31*a*–31*e*, to the terrace areas 60*a*–60*c*, respectively, if desired. Furthermore, the lowermost terrace floor level 30*a* provides a roof enclosure for the rearmost general admission seating, at the rear sections 32*a*, 32*b* of seating area 32.

The prospective audience may thus choose either an open-air or roof-enclosed general admission seating sections 32*a*, 32*b*, or the completely enclosed "living room" type of accommodations or suites 31*a*–31*e*, as described, to view the performance being staged. The suites 31*a*–31*e* will each be provided with individual electronic amplification and speaker equipment to hear the performance being staged when the suites 31*a*–31*e* are completely enclosed.

What has been described and shown herein is a novel combination of elements designed to provide an entertainment structure wherein the audience is presented with a new variety of choices as to how to view the event being staged. This is made possible by the structural design here shown and described.

The entertainment structure of this invention may assume a variety of other embodiments, within the skill of the art. I intend, therefore, to be limited only to the claims which follow:

I claim:

1. A theatre structure which comprises:

a permanent outdoor stage area;

a plurality of tiered rows of individual seating having unobstructed sight lines to said stage area at least some of said individual seating being open-air seating;

a plurality of tiered rows of individual suites, each individual suite being provided with seating areas and non-seating areas situated above and to the rear of said tiered rows of individual seating, each of said individual suites having unobstructed sight lines to said permanent outdoor stage area and each of said individual suites having means for completely enclosing each of said individual suites, and for opening each of said individual suites to said stage area;

a first entrance to said plurality of rows of individual seating; and a second separate lobby entrance leading to said plurality of individual suites.

2. The theatre structure of claim 1 wherein each of said individual suites is provided with multiple floor levels.

3. The theatre structure of claim 1 wherein a portion of said tiered rows of individual seating is covered by the floor of one of the said tiered rows of individual suites .

4. The theatre structure of claim 1 wherein said tiered rows of individual seating are arranged in an arcuate pattern in front of said permanent outdoor stage, and said tiered rows of individual suites are arranged in an arcuate pattern, at least some of said tiered rows of individual seats being generally situated in front of said tiered rows of said individual suites, being openair seating.

5. The theatre structure of claim 1 wherein said separate lobby entrance is a multi-story structure, each story thereof having a first series of entrances leading to multiple hallways, one for each tier of said tiered rows of said individual suites , and a second series of entrances leading to each of said enclosed individual suites from each of said multiple hallways.

6. The theatre structure of claim 5 wherein said multistory structure is situated at the rear of said tiered rows of individual suites remote from said stage area .

7. The theatre structure of claim 1 wherein said non-seating areas of said individual suites includes an office area.

8. The theatre structure of claim 1 wherein said non-seating areas of said individual suites includes a bar area.

9. The theatre structure of claim 1 wherein said non-seating areas of said individual suites includes a kitchen area.

10. The theatre structure of claim 1 wherein said non-seating areas of said individual suites includes a bedroom area.

11. The theatre structure of claim 1 wherein said seating area includes a lounge area.

12. The theatre structure of claim 1 wherein said means for enclosing and opening each of said suites comprises a sliding glass wall.

13. The theatre structure of claim 1 wherein each individual suite includes sound amplification means for amplifying sound from said stage area into said individual suite.

14. The theature structure of claim 1 wherein said first entrance lies proximate said stage area and remote from said individual suites, and said second lobby entrance is located relatively remote from said stage area and relatively proximate to said plurality of individual suites.

15. A theatre structure which comprises:

a permanent outdoor stage area provided with an acoustic shell;

a plurality of tiered rows of individual seating having unobstructed sight lines to said stage area at least some of said individual seating being open-air seating;

a plurality of tiered rows of individual suites, each individual suite being provided with seating areas and lounging areas situated above and to the rear of said tiered rows of individual seating, each of said individual suites having unobstructed sight lines to said permanent stage area and each of said individual suites having sliding glass means for completely enclosing each of said individual suites, and for opening each of said individual suites to said stage area; and further having sound amplification means for amplifying sound from said stage area into said individual suite;

a first entrance of said plurality of rows of individual seating located proximate said stage area and remote from said individual suites; and a second separate lobby entrance leading to said plurality of individual suites, said second lobby entrance being located proximate to said plurality of individual suites and remote from said stage area.

16. The theatre structure of claim 1 wherein said permanent outdoor stage area provided with an acoustic shell.

* * * * *